United States Patent [19]

Anderson et al.

[11] Patent Number: 4,501,937

[45] Date of Patent: Feb. 26, 1985

[54] INTEGRAL MULTISWITCH DISPLAY PANEL

[75] Inventors: Harry B. Anderson; Jack J. Zalewski, both of Bradenton, Fla.

[73] Assignee: Eaton Corporation, Cleveland, Ohio

[21] Appl. No.: 474,939

[22] Filed: Mar. 14, 1983

[51] Int. Cl.[3] ..... H01H 9/26

[52] U.S. Cl. ..... 200/5 A; 200/77; 200/310

[58] Field of Search ..... 200/5 A, 5 R, 77, 16 C, 200/310, 314, 302.2

[56] References Cited

U.S. PATENT DOCUMENTS

| | | | |
|---|---|---|---|
| Re. 26,936 | 7/1961 | Waldorf | 200/314 |
| 2,347,874 | 5/1944 | Bluemle | 200/77 |
| 2,466,970 | 4/1949 | Schellman | 200/77 |
| 3,240,885 | 3/1966 | Grunfelder et al. | 200/5 |
| 3,749,859 | 7/1973 | Webb et al. | 200/5 R |
| 3,806,673 | 4/1974 | Boulanger | 200/5 A |
| 3,858,019 | 12/1974 | Muri | 200/5 A |
| 3,903,381 | 9/1975 | Diehr | 200/5 R |
| 4,056,701 | 11/1977 | Weber | 200/314 |
| 4,154,178 | 5/1979 | Brown et al. | 112/158 E |
| 4,179,594 | 12/1979 | Coyle | 200/310 |
| 4,291,201 | 9/1981 | Johnson et al. | 179/90 K |
| 4,320,268 | 3/1982 | Brown | 200/5 A |
| 4,331,851 | 5/1982 | Johnson | 200/159 B |

*Primary Examiner*—E. A. Goldberg
*Assistant Examiner*—M. J. Reinhart
*Attorney, Agent, or Firm*—C. H. Grace; W. A. Autio

[57] ABSTRACT

An integral multiswitch display panel (FIG. 3) having a plurality of pushbutton switches (A1–4, B1–4, C1–4, D1–4) mounted thereon along with a signal lamp (16) for each switch. A control circuitry P.C. board (44) and a display drive P.C. board (10) are common to all the switches with the control contacts (40, 42) of the switches controlling the displays (24) within the respective pushbuttons to provide on-off or alpha-numeric informational indications in response to operation of the bushbutton switches. The printed circuit lines of the control circuitry P.C. board (44) are connected through hermetically sealed connectors (50, 52, 54) at the bottom of the display panel to external controlled circuits with at least some of these lines being connected to the display drive P.C. board (10) for controlling the displays (24). The pushbuttons are environmentally sealed by a common seal (8) to prevent dirt, water, and the like from entering inside the panel housing (2, 4).

10 Claims, 6 Drawing Figures

INTEGRAL MULTISWITCH DISPLAY PANEL

BACKGROUND OF THE INVENTION

Integral multiswitch panels have been known heretofore. For example, P. J. Grunfelder et al, U.S. Pat. No. 3,240,885, dated Mar. 15, 1966, shows a multiple switching apparatus having an array of pushbuttons with each pushbutton being capable of closing two circuits, an upper printed circuit board circuit and a lower ground circuit. When each pushbutton is depressed, the lower ground circuit is closed to energize a relay which closes its contacts to provide, for example, a power source for the multifrequency signal selected by the printed circuit board switch. The printed circuit board switch is also closed on depression of the pushbutton. This is done by depressing a coiled spring ground wire that contacts the printed circuit at opposite edges of a hole in the printed circuit board. Other multiswitch panels have also been known. However, these prior multiswitch panels have generally been handicapped by their extreme complexity or their incapability of providing the desired features. Presently known multiswitch panels consists generally of multiple switches having only one function each with simple incandescent on/off signaling. Such designs have very bulky wiring, high power consumption, high heat emission, sizable space requirements and relatively low life of indicator lights. While such prior art devices have been useful for their intended purposes, this invention relates to improvements thereover.

SUMMARY OF THE INVENTION

An object of the invention is to provide an improved integral multiswitch display panel.

A more specific object of the invention is to provide a compact, highly reliable, manually operated, sealed, integral multiswitch display panel.

Another specific object of the invention is to provide an integral multiswitch display panel of the aforementioned type with a fully programmable function that provides custom displays that range from a simple on/-off signaling to multicharacter alpha-numeric readouts.

Another specific object of the invention is to provide an integral multiswitch display panel of the aforementioned type that is simple in construction and economical to manufacture.

Other objects and advantages of the invention will hereinafter appear.

DESCRIPTION OF THE PREFERRED EMBODIMENT

Figure 1:
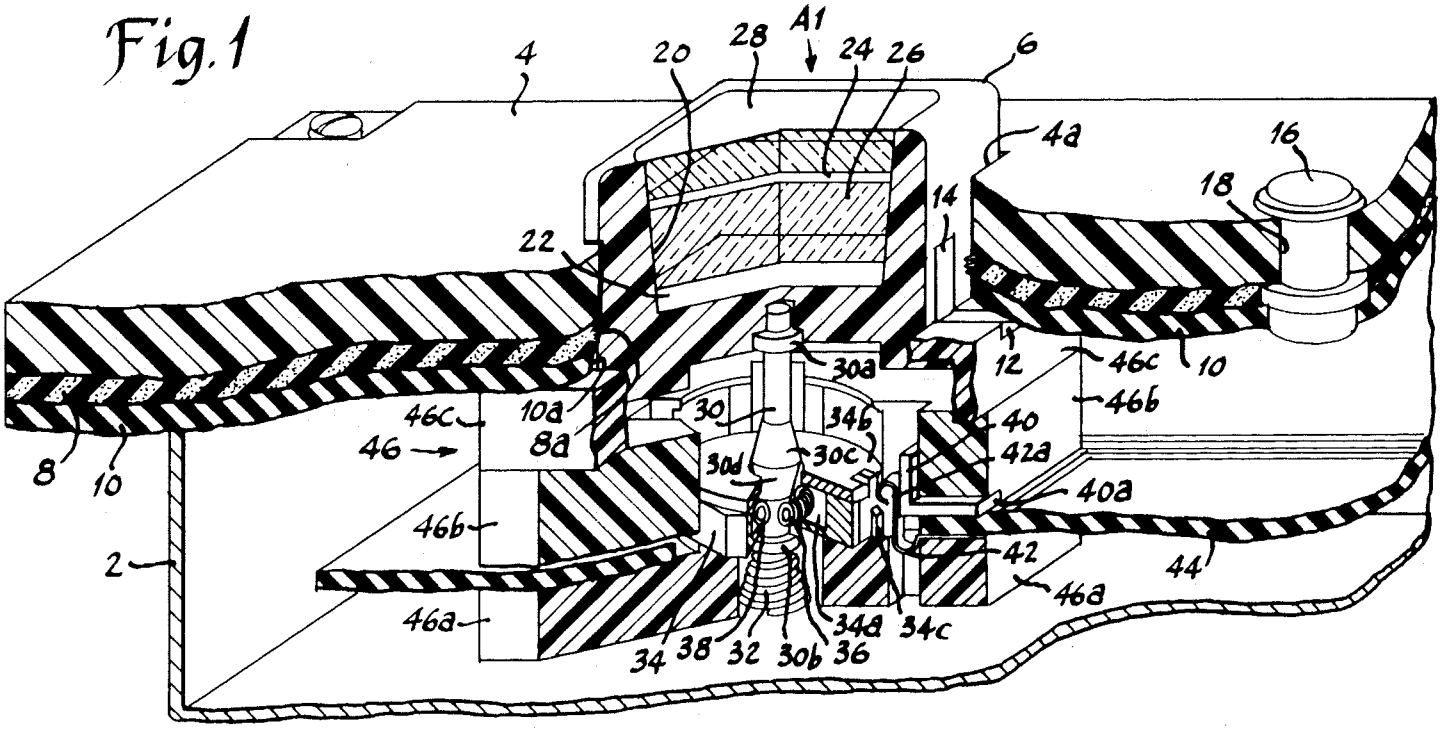
FIG. 1 is an enlarged isometric cross-sectional view of a miniature multipole double-throw snap-action pushbutton switch with alpha-numeric display used in the integral multiswitch display panel of the invention.

Referring to the drawings, FIG. 1 shows a miniature multipole double-throw snap-action pushbutton switch with display such as switch A1 which is one of 16 switches used in the integral multiswitch display panel of FIGS. 3–6. As shown in FIG. 1, the switch is provided with a housing 2 closed by a cover in the form of a panel 4 having a hole **4*a* therein through which pushbutton 6 of the switch extends for manual actuation by the user. An environmental seal 8, that is, a seal that excludes dirt, dust and moisture, underlies panel 4 and hugs pushbutton 6 to prevent dirt of the aforementioned type from entering around the pushbutton into housing 2. A printed circuit board 10 underlies seal 8 and is electrically connected to the display elements within the pushbutton by a plurality of contact sets, each having a stationary brush contact 12 mounted below and secured to printed circuit board 10 as shown in FIG. 1 and a movable contact 14 mounted on the pushbutton. Other movable contacts not shown in FIG. 1 may be mounted on the pushbutton in spaced relation to movable contact 14, as can be surmised from the printed circuit board shown in FIG. 2, so that it will be apparent that a plurality of similar pairs of contact sets may be spaced around the pushbutton for making electrical connections from the printed circuit board to the display within the pushbutton as hereinafter more fully described. When the pushbutton is depressed, the outer face of movable contact 14 slides on the curved, compression portion of stationary brush contact 12 to maintain electrical contact therebetween throughout the pushbutton travel. The curved, compression portion of stationary brush contact 12** is more fully illustrated and described in J. J. Zalewski and Walter C. Theurer copending application, Ser. No. 468,925, docket filed Feb. 23, 1983.

As shown in FIG. 1, an indicator light 16 mounted in a light socket 18 may be provided in panel 4 and also extending through seal 8 and printed circuit board 10 and connected to the printed circuit board to be lighted as a signal by one of the switch contact sets or upon application of power to the panel or the like.

As shown in FIG. 1, pushbutton 6 is provided with a recessed or pocket 20 extending down from the top thereof which is filled with the following elements. At the bottom of this pocket is a planar source of illumination or light source 22 which may include different or plural colored LED's (Light Emitting Diodes), incandescent lamps, LCD's (Liquid Crystal Display), or the like. The terminals of the electrical elements of light source 22 are at the edge thereof where they are connected to movable contact 14. Pocket 20 in the pushbutton is slightly flared upwardly and part way up has a shoulder at least on two sides thereof for supporting a planar indicia display plate 24 and the space therebelow is filled with a plastic epoxy 26 or the like. Alternatively, a single or multi-color LED or LCD display may be used in place of plate 24 and connected to contacts 14 for energization, in which case illumination source 22 is not required. The space above display 24 is filled with a clear or translucent plastic epoxy 28 level with the top of the pushbutton to provide a smooth surface thereon for engagement by the finger of the user. As will be apparent, when the pushbutton is depressed, it is guided by and slides smoothly within hole **4*a* in panel 4 and is provided clearance by a corresponding hole 10***a* in printed circuit board 10. Seal 8 has a slightly smaller hole 8*a* therein so that it resiliently hugs pushbutton 6 to seal the switch housing from the outside.

As shown in FIG. 1, switch actuator shaft 30 has a flange 30*a* near its upper end whereby it is seated in a stepped blind hole in the lower end of pushbutton 6. A similar flange 30*b* is provided near the lower end of operating shaft 30 for retaining the upper, smaller end of a frusto-conical return spring 32, the larger, lower end of which abuts the bottom of housing 2. The midportion of operating shaft 30 is provided with integral double inclined, frusto-conical surfaces 30*c* and 30*d*. Actuator cam block 34 is provided with an internal pocket 34*a* shown in FIG. 1 which is partially covered by a top plate 34*b*. This pocket 34*a* has a configuration such that it retains a pair of helical springs 36 and 38 and presses them against opposite sides of operating shaft 30 with sufficient outside clearance at the midpoints of these two springs to allow the double inclined cam portion 30*c–d* of the operating shaft to be pressed over-center therebetween thereby to snap actuator cam block 34 up when the pushbutton is depressed and to snap it back down when the pushbutton is released and return spring 32 returns the pushbutton to its normal position. Alternatively, a single circular helical garter spring could be used in place of helical springs 36 and 38.

Figure 2:
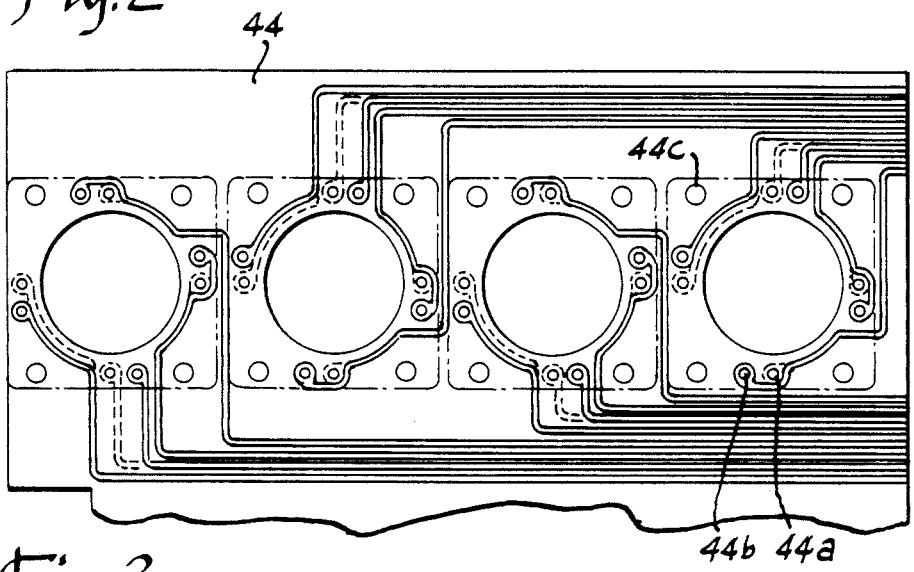
FIG. 2 is an enlarged top view of a portion of the control circuitry printed circuit board used in the integral multiswitch display panel of the invention.

Actuator cam block 34 operates a plurality of control contact sets angularly distributed and spaced therearound, each such contact set having a stationary contact 40 and a movable contact 42 as shown in FIG. 1, and four contact sets being provided for as shown by the structure of the printed circuit board in FIG. 2. Each such contact set includes an angular stationary contact 40 and a generally S-shaped movable butt contact 42 as shown in FIG. 1. Horizontal portion 40*a* of stationary contact 40 is electrically connected to or abuts a terminal 44*a* on the upper surface of a control circuitry printed circuit board 44 shown in FIG. 2. Movable contact 42 is electrically connected to or abuts a terminal 44*b* on the lower surface of control circuitry printed circuit board 44 as shown in FIGS. 1 and 2. The other three contact sets are equally spaced around switch actuator 34 and connected to the other three pairs of terminals on printed circuit board 44 as can be seen in FIG. 2. The upper rounded loop portion 42*a* of movable contact 40 is actuated by a suitable cam 34*c* integrally molded on actuator block 34 as shown in FIG. 1. This cam may be a normally-open cam or a normally-closed cam as shown and described in the aforementioned J. J. Zalewski and W. C. Theurer copending application. Top plate 34*b* may be secured to the base portion of actuator block 34 by a pair of rivets or the like well known in the art. Base 46 of the pushbutton switch includes a lower portion 46*a*, a midportion 46*b* and an upper portion 46*c* which may be secured to one another by 4 rivets, screws, or the like, extending vertically therethrough and through holes 44*c* in printed circuit board 44 shown in FIG. 2 with printed circuit board 44 and the terminals of movable contacts 42 and stationary contacts 40 being confined or clamped between lower portion 46*a* and midportion 46*b* as shown in FIG. 1. Housing 2 may be connected to panel 4 in any suitable manner to mount the pushbutton switch therein with its pushbutton extending above the upper surface of the panel for depression by the user and for viewing and reading the display thereon.

Figure 3:
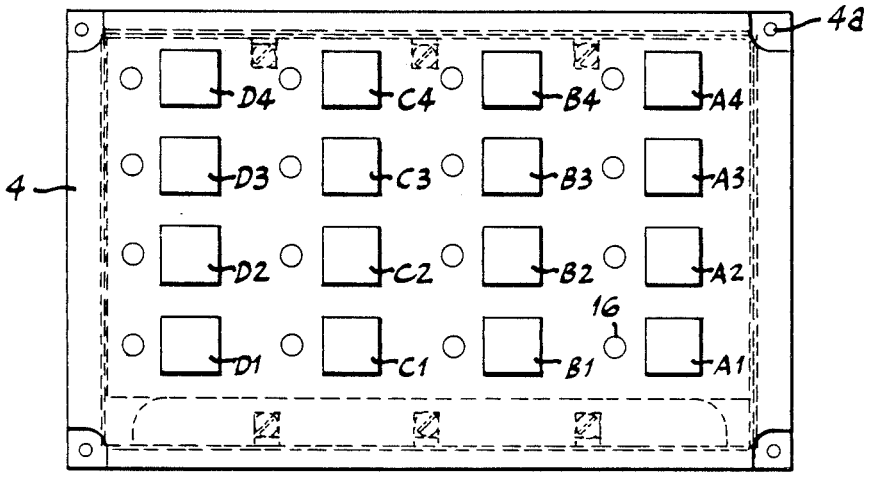
FIG. 3 is a top view of the integral multiswitch display panel constructed in accordance with the invention.

A complete unit of the integral multiswitch display panel is shown in FIG. 3. As shown therein, the panel is provided with 16 pushbuttons, but may be less than and not limited to 16, including pushbuttons A1–4 in the first column, pushbuttons B1–4 in the second column, pushbuttons C1–4 in the third column and pushbuttons D1–4 in the fourth column. Each of these pushbuttons is like the pushbutton illustrated in FIG. 1. Holes 4*a* at the corners of panel 4 are for receiving screws or the like for connecting panel 4 to a flange 2*a* or the like at the upper portion of housing 2.

FIG. 2 shows a portion of control circuitry P.C. board 44, this being the right end portion with reference to FIG. 3 which provides the circuitry for the control contacts of pushbuttons A1–4. As shown in FIG. 2, all of the printed circuit lines from the control switch contacts extend to the right-hand edge of the printed circuit board 44, this being the front edge of the printed circuit board when oriented according to FIG. 3. Since the printed circuit board in FIG. 2 provides for 4 contact sets in each pushbutton switch in the column with each contact set having a stationary contact and a movable contact, the printed circuit lines connected to the 16 stationary contacts are on one surface of the P.C. board and the 16 printed circuit lines connected to the movable contacts are on the other surface of the P.C. board. Thus, for each column of pushbuttons in FIG. 3, there will be 32 connections at the lower edge of the board some of which go to the associated display control circuits and others of which go to the connectors hereinafter described.

Figure 5:
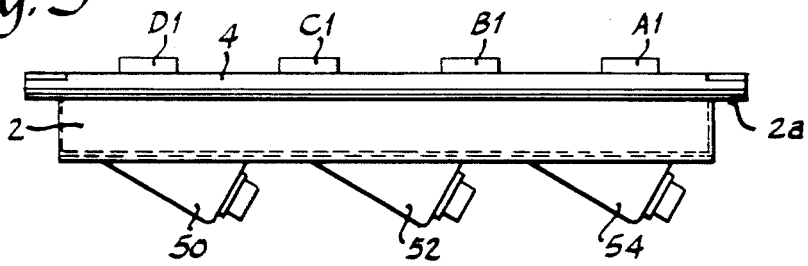
FIG. 5 is a front view of the integral multiswitch display panel of FIG. 3.
Figure 4:
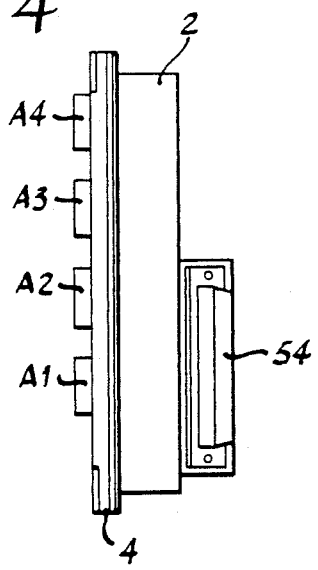
FIG. 4 is a right end view of the integral multiswitch display panel of FIG. 3.
Figure 6:
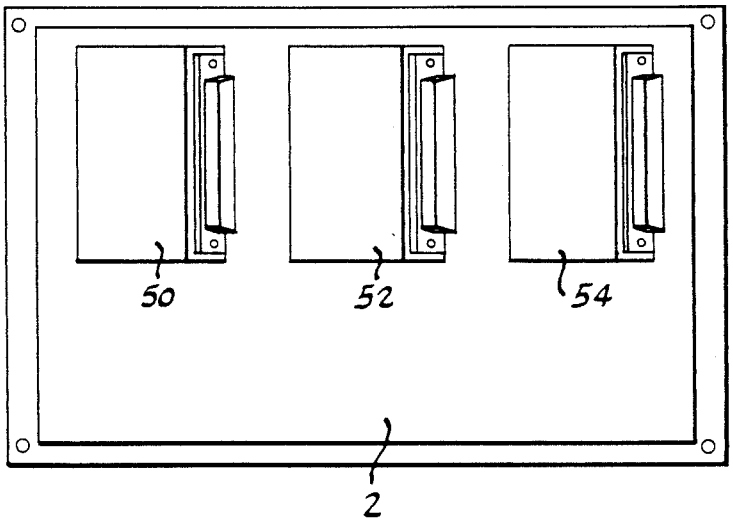
FIG. 6 is a bottom view of the integral multiswitch display panel of FIG. 3.

As shown in FIGS. 4–6, the integral multiswitch display panel has three connectors 50, 52 and 54 at the bottom of housing 2. These are preferably hermetically sealed connectors to which the printed circuit board lines are connected so that the panel pushbuttons can be used to control external circuits. Some of these P.C. board lines are also connected through electronic decoders or the like to display P.C. board 10 so as to activate the displays on the push-buttons to provide a variety of messages to the user. The electronic decoders and other circuitry that are used to select particular messages for display may be mounted either internally or externally of housing 2 but preferably are mounted within housing 2 as there is sufficient room for the extremely small electronic components that are used. An operational principle of the integral multiswitch display panel may be as follows. When a pushbutton is manually depressed, a snap-action multipole switch makes or breaks control circuitry. To decrease switch contact erosion, the control circuitry P.C. board 44 can be furnished with electrical elements such as diodes, varistors, resistors, etc. that are connected through the printed circuit to the contacts in known manner to keep such contact erosion to a minimum. Operation of the pushbuttons to make or break the control circuits activates the display drive circuitry on P.C. board 10 and the pushbutton alpha-numeric displays and/or signal lights will light up, describing the change in function and detailed information on that function. Each panel can be preprogrammed for a variety of functions. The drive circuitry generally consists of a decoder-driver chip, input multiplexer, scan decoder and clock/counter. LED's or LCD's located inside the switch pushbutton provide multicharacter alpha-numeric customer display and because of its small size can be grouped into clusters or closely packed rows. The operating life of such electronic displays is much longer than that of incandescent lamps and their power drain is very low. In addition, LCD indicators can provide easy, customized scroll displays, such scroll displays being of the rollover or sequencing type. In applications for use in extremely difficult ambient conditions, especially those having high light surroundings such as an airplane cockpit, incandescent indicators will be used and flashed up by drive circuitry P.C. board elements to a sufficiently high frequency to be sensitive to the human eye. These arrangements reduce power consumption and heat emission and allow incandescent indicators to be closely packed and located near heat-sensitive components without any adverse effects.

While the apparatus hereinbefore described is effectively adapted to fulfill the objects stated, it is to be understood that the invention is not intended to be confined to the particular preferred embodiment of integral multiswitch display panel disclosed, inasmuch as it is susceptible of various modifications without departing from the scope of the appended claims.

We claim:

1. A manually-operated integral multiswitch control and display panel comprising:

an open top housing;

a multiswitch panel closing the top of said housing and having a plurality of openings therein;

a plurality of pushbutton switches, each having an insulating base within said housing and a pushbutton extending up through one of said openings;

a control circuitry printed circuit board within said housing common to said switches and having a plurality of holes therein, one for each of said switches;

each said switch having stationary and movable contact means mounted on the rim of the associated hole and connected to the printed circuit on said board and actuator means within said base comprising an actuating member extending from the associated pushbutton down through said hole for closing and opening said contact means when said pushbutton is actuated;

an electrically energizable multicharacter display mounted within said pushbutton so as to be visible from the top thereof;

a display drive printed circuit board beneath said panel common to said switches and having a plurality of apertures therein, one for each of said pushbuttons;

each said switch having sliding connector means comprising stationary contacts mounted on the rim of the associated aperture and connected to the display drive printed circuit on said board and movable contacts mounted on said pushbutton and connected, to said display;

and means whereby said display is controlled through said display drive printed circuit board and said control circuitry printed circuit board in response to operation of said pushbutton switches.

2. The manually-operated integral multiswitch control and display panel claimed in claim 1 wherein:

said multiswitch panel also comprises a seal beneath said panel common to said switches and snugly embracing each said pushbutton for sealing the interior of said housing from the outside.

3. The manually-operated integral multiswitch control and display panel claimed in claim 1, wherein:

said panel comprises at least one indicator light mounted in a hole in said panel and electrically connected to said display drive printed circuit board for energization thereby.

4. The manually-operated integral multiswitch control and display panel claimed in claim 1, wherein:

said control circuitry printed circuit board has a plurality of groups of printed circuits thereon with each said group having printed circuits for a plurality of pushbutton switches therein, and connector lines of the printed circuits in each said group extend to one edge of said printed circuit board for connection to terminals.

5. The manually-operated integral multiswitch control and display panel claimed in claim 4, wherein:

said panel also comprises a plurality of sealed connectors to which said connector lines are connected and which are accessible on the outside of said panel.

6. The manually-operated integral multiswitch control and display panel claimed in claim 1, wherein:

said electrically energizable multicharacter display in each said pushbutton is an alpha-numeric display.

7. The manually-operated integral multiswitch control and display panel claimed in claim 1, wherein:

said insulating base is a multipart enclosure clamping said control circuitry printed circuit board between parts thereof.

8. The manually operated integral multiswitch control and display panel claimed in claim 1, wherein:

said electrically energizable display is mounted in a slot in said pushbutton;

and light transmitting material covering said display to the top surface of said pushbutton.

9. The manually-operated integral multiswitch control and display panel claimed in claim 1, wherein:

said actuator means comprises a return spring biasing said actuating member upwardly for returning said pushbutton following depression thereof.

10. The manually-operated integral multiswitch control and display panel claimed in claim 1, wherein:

said actuating means comprises a snap-action actuator block for operating said movable contact means in response to movement of said actuating member.

* * * * *